US005136812A

United States Patent [19]

Voegele

[11] Patent Number: 5,136,812

[45] Date of Patent: Aug. 11, 1992

[54] TOP HINGED SASH CONSTRUCTION AND ASSOCIATED WINDOW CONSTRUCTION AND RELATED METHODS

[76] Inventor: William P. Voegele, 200 Bridge St., Pittsburgh, Pa. 15223

[21] Appl. No.: 679,671

[22] Filed: Apr. 3, 1991

[51] Int. Cl.[5] ..... E05D 7/00

[52] U.S. Cl. ..... 49/397; 49/402; 49/475; 49/484; 49/501; 49/506

[58] Field of Search ..... 49/397, 485, 498, 402, 49/501, 506; 52/785, 399, 790, 371, 171

[56] References Cited

U.S. PATENT DOCUMENTS

| | | | |
|---|---|---|---|
| 2,845,665 | 8/1958 | Place | 49/397 |
| 3,266,192 | 8/1966 | Kolm | 49/397 |
| 3,353,318 | 11/1967 | Bacher | 49/498 X |
| 3,859,754 | 1/1975 | Budich et al. | 49/501 X |
| 3,935,683 | 2/1976 | Derner et al. | 52/790 X |
| 4,051,633 | 10/1977 | Voegele, Jr. . | |
| 4,084,348 | 4/1978 | Hast | 49/475 |
| 4,087,940 | 5/1978 | Voegele, Jr. . | |
| 4,563,843 | 1/1986 | Grether et al. | 52/790 X |
| 4,644,697 | 2/1987 | Nida | 49/397 X |
| 4,656,785 | 4/1987 | Yackiw | 49/485 X |
| 4,676,026 | 6/1987 | Schreiner | 49/501 |
| 4,850,175 | 7/1989 | Berdan | 52/790 |

*Primary Examiner*—Philip C. Kannan

*Attorney, Agent, or Firm*—Arnold B. Silverman; David V. Radack

[57] ABSTRACT

The top hung sash assembly of the invention comprises a hinge bar and a frame assembly hingedly connected to the hinge bar. The frame assembly includes a head extrusion member, a sill member and two side members with at least one glazing member mounted therein. The head extrusion includes a first flange which defines a recess. Secured in the recess is weatherstripping which contacts the hinge bar when the frame assembly is closed against the hinge bar. The weatherstripping is only partially compressed when the frame assembly is closed against the hinge bar. The invention further provides a window construction and a related method for joining a plurality of window assemblies which properly spaces the assemblies relative to the building opening and each other and which allows for subsequent thermal expansion and contraction while remaining sealed.

36 Claims, 4 Drawing Sheets

TOP HINGED SASH CONSTRUCTION AND ASSOCIATED WINDOW CONSTRUCTION AND RELATED METHODS

BACKGROUND OF THE INVENTION

1. Field of the Invention

This invention relates to a top hinged sash construction and an associated window construction.

2. Background Information

Top hung swinging industrial sashes are well known. My U.S. Pat. No. 4,087,940 describes a top hinged sash assembly consisting of a hinge bar mounted to a building girt, a frame assembly which holds a glazing panel and an operator. The hinge bar has an integral drip cup and a substantially J-shaped hinge rail. The frame assembly includes an extruded head member, an extruded sill member and two side members connected in rectangular relationship. The frame assembly is connected to the hinge bar through a curved and beaded head rail extending upwardly from the head member.

The prior art top hinged sash assemblies have relied on the hinge itself to provide a seal between the sash assembly and the building. This seal however allows air from outside the building to enter the building through the hinge. This, of course, can increase heating and/or cooling costs of the building with which the sash assemblies are associated.

Another problem of the prior art sash assemblies is proper alignment and installation of a series of assemblies to fill a large opening in a building. The sash assemblies must be positioned to fill the opening yet have enough space therebetween to allow for thermal expansion of the sash assemblies. In addition, the sash assemblies must be securely joined to adjacent sash assemblies. Further, such joining should be quickly and easily accomplished without the need for fasteners such as bolts or screws.

There is a need for a top hung sash construction that provides a weathertight seal. There is also a need to provide a top hung sash assembly construction that can easily be installed and aligned with other assemblies in order to fill a building opening and which allows for the thermal expansion of the system.

SUMMARY OF THE INVENTION

The top hung sash assembly of the invention has met the above-described needs. The assembly comprises a hinge bar and a frame assembly hingedly connected to the hinge bar. The frame assembly includes a head extrusion member, a sill member and two side members with at least one glazing member mounted therein. The head extrusion includes a head extrusion flange which defines a recess. Disposed in the recess is weatherstripping which contacts the hinge bar when the frame assembly is closed against the hinge bar. The weatherstripping is only partially compressed when the frame assembly is closed against the hinge bar.

The window construction of the invention also includes providing a first and second top hung hinged window sash and means to join the first and second top hung hinged window sashes to each other. The joining means includes a hook member attached to one of the sashes and a ramp member attached to the other window sash. This structure allows the window sashes to be joined by effecting relative movement of said hook member and said ramp member to effect interengagement therebetween. The invention further provides a positioning means embodied by a resilient spacer that is positioned between the two window sashes. The resilient spacer maintains the proper distance between the window sashes during installation but also can be crushed to permit subsequent thermal expansion of the window sashes relative to each other.

It is an object of the invention to provide a top hung sash assembly that provides a weathertight seal.

It is a further object of the invention to provide that the frame assembly of the sash construction seals against the hinge rail of the sash construction.

It is a further object of the invention to provide an easy and accurate way of joining adjacent sash assemblies to form a series of sash assemblies that fill an opening in a building.

It is a further object of the invention to provide an alignment method that also allows for thermal movement of adjacent sash assemblies relative to each other.

It is a further object of the invention to provide a double face glazing panel in the sash assembly.

It is a further object of the invention to provide an efficient structure to facilitate evacuation of condensation between the faces of the glazing panel.

These and other objects of the invention will be fully understood from the following description of the invention with reference to the illustrations appended to this application.

BRIEF DESCRIPTION OF THE DRAWINGS

FIG. 2 is a section taken along line 3—3 of FIG. 1.

DESCRIPTION OF THE PREFERRED EMBODIMENT

Figure 1:
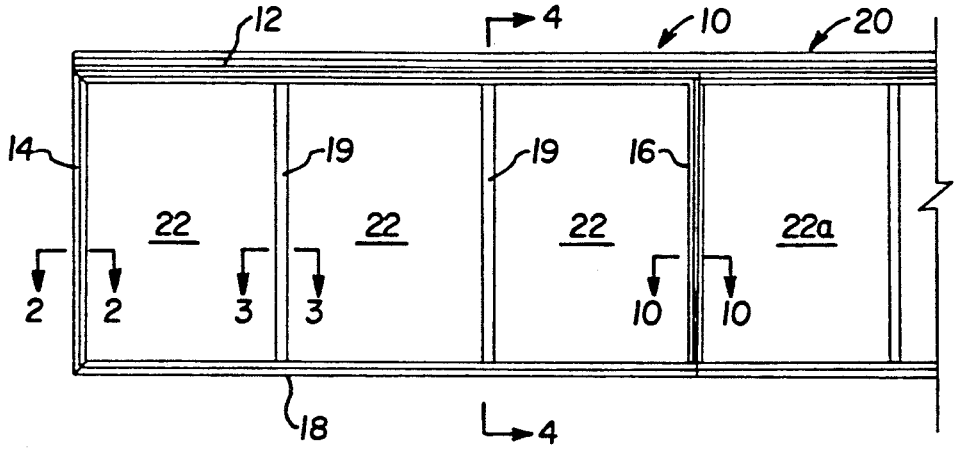
FIG. 1 is a front elevational view of a first sash assembly joined to a second sash assembly.

Referring to FIG. 1, the sash assembly 10 of the invention is of a top hinge awning-type having a hinged swinging panel. The sash assembly 10 includes a frame comprised of a main head extrusion 12, a side jamb member extrusion 14, a half mullion extrusion 16 and a bottom sill member 18 joined in a substantially rectangular relationship. Two vertical mullions 19 extend between the head extrusion 12 and the bottom sill member 18. The sash assembly 10 in the form shown is connected to a second sash assembly 20 as will be further explained hereinafter with respect to FIG. 10. A glazing panel 22 or plurality of glazing panels 22 form part of the sash assembly 10. The frame member portions of the sash assembly 10 are normally made of metal extrusions of aluminum or the like but can also be extruded plastic or sections formed from sheet metal.

Figure 2:
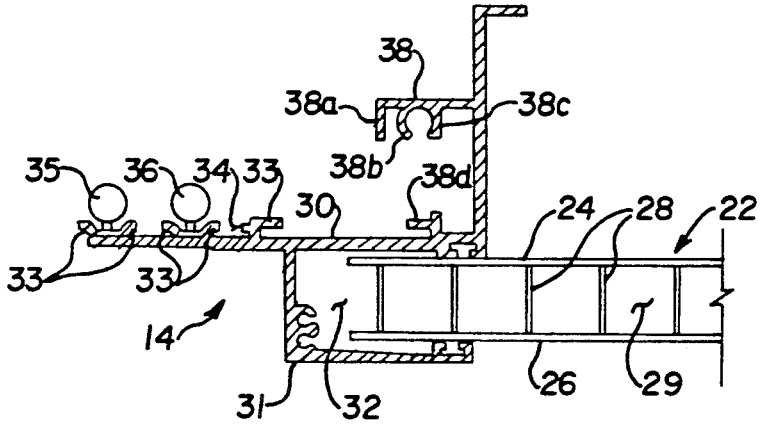
FIG. 2 is a section taken along line 2—2 of FIG. 1.

The glazing panel 22 in the form shown is a translucent cellular polycarbonate material such as that sold under the trade name Thermoclear by General Electric. As can be seen in FIG. 2, the glazing panel 22 has a double wall construction with an inside face 24 and an outside face 26. A plurality of vertical members such as 28 are formed between the walls 24 and 26 to define enclosed space 29. It will be appreciated that the glazing panel 22 is not limited to this material and construction and may be clear, opaque or even insulated as well as being of a single wall construction. The sash assembly finds primary use in industrial or commercial applications, but it may also be used in residential applications. The frame may also be used with other sash types by providing appropriate side hinging, pivoting or projection hardware.

Referring again to FIG. 2, the side jamb member 14 has a double bent back section 30 and a bent front section 31 which define a space 32 in which the glazing panel 22 is mounted. Section 30 includes projecting flanges 33 which define channels 34 into which weatherstripping 35 and 36 can be positioned. Weatherstripping 35 and 36 will be described hereinafter with reference to FIG. 5. This provides a seal between the sash assembly 10 and the building girt or flashing to resist undesired air flow in and out of the building. Section 30 also includes a flange 38 further extending therefrom. Flanges 38*a*, 38*b*, 38*c* and 38*d* are also provided in order to create cavities which accept metal corner keys and screws for the purpose of securing the mitred corners of jamb side member 14 and bottom sill member 18.

Figure 3:
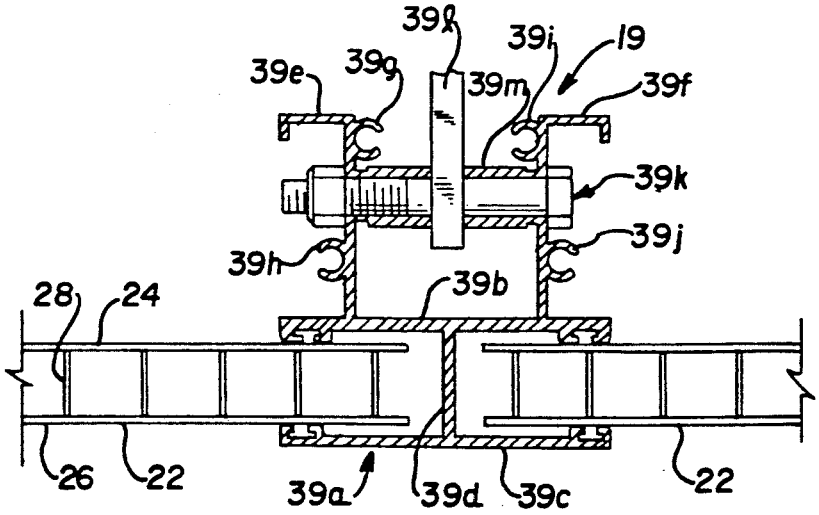

Referring now to FIG. 3, the mullion 19 is shown. The mullion 19 consists of a H-shaped flange 39*a* having a back flange portion 39*b* and a front flange portion 39*c* which is connected by flange member portion 39*d*. Two flanges 39*e* and 39*f* extend from back flange portion 39*b*. Flange 39*e* includes screw bosses 39*g* and 39*h* while flange 39*f* includes screw bosses 39*i* and 39*j*. A bolt and nut assembly 39*k* is also provided, which is preferably a 5/16" bolt with a locking nut. The locking nut allows the bolt to be long enough to allow for thermal expansion and contraction, but still not become separated from the nut due to looseness. A rack arm 39*l* is also provided which operates the opening and closing of the window sash as will be described further hereinafter with respect to FIG. 4. Finally, a plastic spacer 39*m* is provided which keeps the rack arm 39*l* centered. The spacer 39*m*, as is the nut and bolt assembly 39*k*, is designed to allow for thermal movement of the joint.

Figure 4:
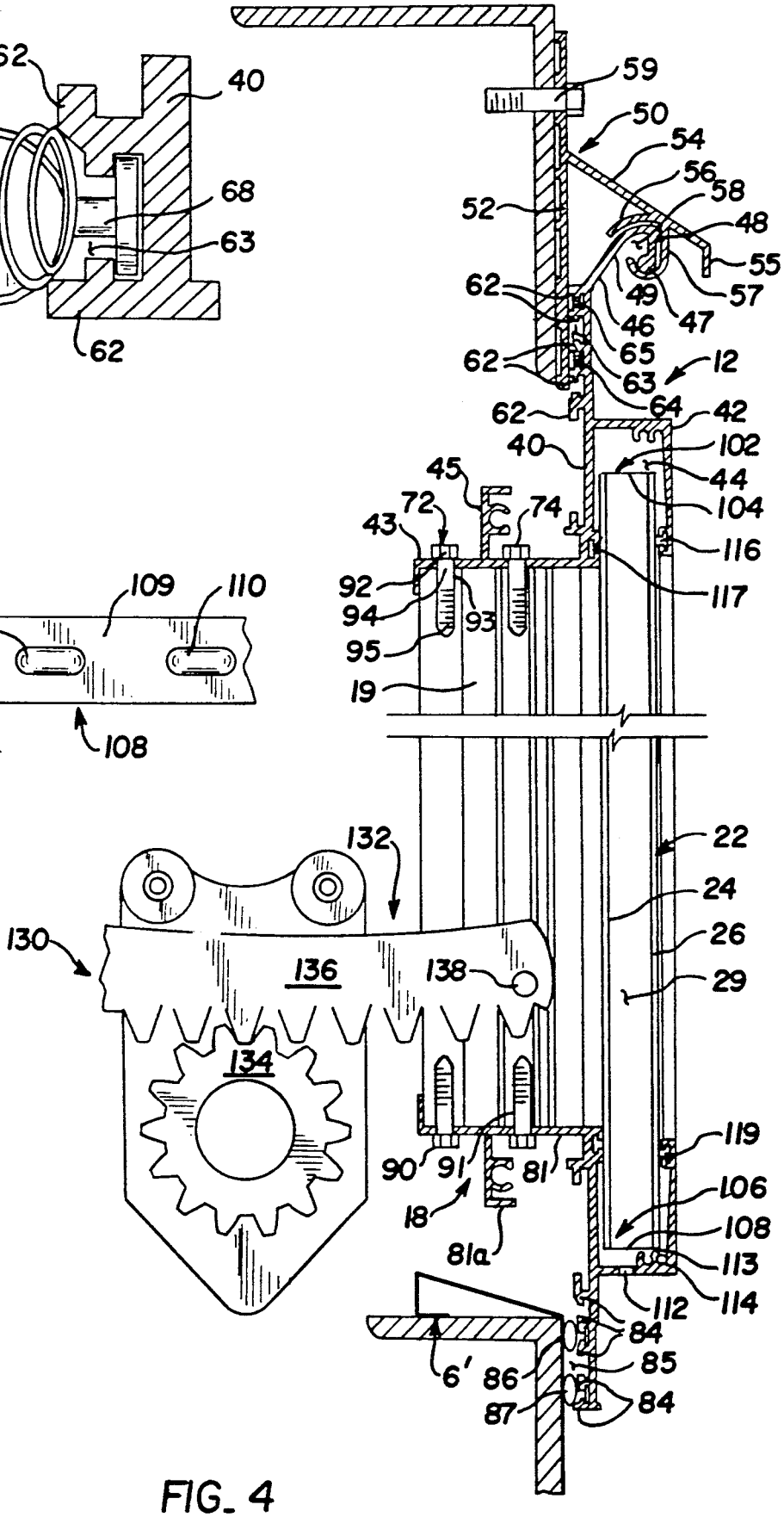
FIG. 4 is a section taken along line 4—4 of FIG. 1.

Referring now more particularly to FIG. 4, the main head extrusion 12 consists of a rearward leg 40 and a forward leg 42 extending therefrom so as to form a channel 44 therebetween. Leg 40 has horizontal flange 43 from which flange 45 extends vertically upward. Flanges 40 and 45 hold corner keys and screws (not shown) for the purpose of joining mitred corners between head extrusion member 12 and jamb side member 14. Leg 40 terminates in curved upside down J-shaped head rail 46 having an enlarged bead 47 at its free end and a projection 48 intermediate the enlarged bead 47 and portion 49 of the J-shaped head rail 46.

Head extrusion 12 is positioned in the hinge rail 50. The hinge rail 50 consists of a vertical leg 52 and a diagonal leg 54 extending therefrom at an angle of approximately forty-five degrees. Diagonal leg 54 terminates in a downwardly extending flange 55. Two intermediate flanges 56 and 57 extend from diagonal leg 54 and define a space 58. Intermediate flange 56 extends in an arcuate downwardly direction from the diagonal leg 54 and intermediate flange 57 is in the form of a "J". Head rail 46 is received in space 58 with enlarged bead 47 contacting J-shaped intermediate flange 57. This structure allows for the main head extrusion 12 to swing from the fixed hinge rail 50. Hinge rail 50 is apertured to accommodate a threaded fastener 59 for connection to a building girt G.

Figure 5:
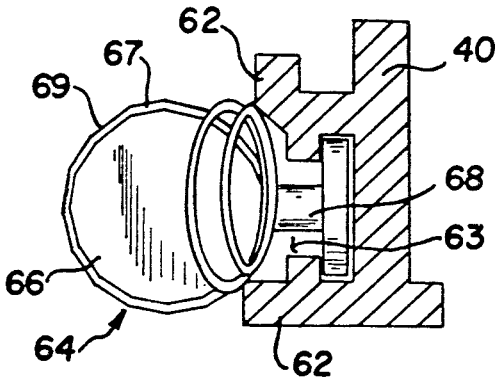
FIG. 5 is a detailed view of the weatherstripping of the invention.

Referring to FIGS. 4 and 5, leg 40 includes a plurality of horizontally extending flanges 62 which define cavities such as 63. Placed in one or more of these cavities is weatherstripping 64 and 65. When the main head extrusion 12 is closed against the hinge rail 50, projection 48 will bear against flange 57 to force weatherstripping 64 and 65 against leg 52 of the hinge rail 50.

FIG. 5 shows weatherstripping 64 which consists of a foam core 66 which is surrounded by an elastomeric exterior wrap 67. The weatherstripping has a base 68 and a bulb portion 69. The base portion 68 is connected to the leg 40 by adhesives. As can be seen in the phantom representation in FIG. 5, weatherstripping 64 is adapted to be crushed to a predetermined level, but not fully crushed, when the main head extrusion 12 is closed against the hinge rail 50. The flanges 62 are sized and positioned so that the weatherstripping 64 will bear against the sides thereof when it is in a partially compressed position. The weatherstripping material has a memory and will return to its original shape when it is not pressed against the hinge rail 50. This provides a consistent seal between the sash assembly 10 and hinge rail 50 which resists undesired cold or warm air from flowing either out or into the building upon which the sash assembly 10 is mounted.

Referring back to FIG. 4, the main head extrusion 12 is connected at its ends to vertical mullion 19 by screws 72 and 74. The mullion 19 extends between rearward leg 43 and the bottom sill 18. Bottom sill 18 consists of a double bent rearward leg 80 and a bent forward leg 82 extending therefrom to form a space 83. Leg 80 has horizontal portion 81 from which flange 81*a* extends vertically downward. Flanges 81 and 81*a* hold corner keys and screws (not shown) for the purpose of joining mitred corners between bottom sill member 18 and jamb side member 14. Leg 80, similarly to leg 40, has a plurality of horizontally extending flanges 84 which define cavities such as 85. Placed in these cavities are weatherstripping 86 and 87 similar to weatherstripping 64 and 65. Weatherstripping 86 and 87 is partially crushed when pressed against bottom building girt and flashing assembly G'. This provides a consistent seal between the sash assembly 10 and the building girt and flashing assembly G' to resist undesired air flow in and out of the building. Screws 90 and 91 connect the bottom sill 18 to the vertical mullion 19.

The screws 72, 74, 90 and 91 such as screw 72, have a head 92 and a neck 93 having an unthreaded portion 94 near the head 92 and a threaded portion 95 extending from the unthreaded portion 94. The relief of the threads allows the screws to be tightened without the possibility that they will thread into both of the elements that they are engaging.

Figure 6:
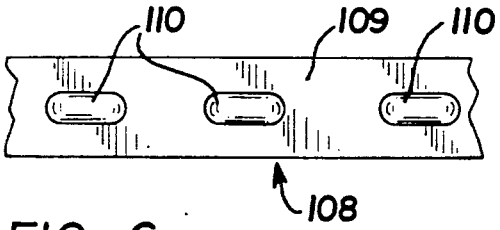
FIG. 6 is a top plan view of the air permeable tape.

The glazing panel 22 is mounted in the space 44 formed by the main head extrusion 12 and the space 83 formed by the bottom sill 18. The top end 102 of the panel is typically covered by a solid foil tape 104. The bottom end 106 of the panel 22 is covered by an air permeable venting tape 108. A segment of this tape 108 is shown in FIG. 6. The tape 108 consists of a solid portion 109 and a plurality of intermediate permeable portions 110. Moisture and condensation from space 29 of glazing panel 22 can be vented through the permeable portion 110 and into space 83. The bottom sill extrusion 18 also includes a plurality of weep holes such as weep hole 112 which allows the condensation and moisture to further be vented from space 83. In order to avoid the panel lying in moisture, setting fins 113 and 114 are formed on the horizontal section of leg 82. The setting fins 113 and 114 in addition allow ventilation air to reach the bottom of the panel 22.

The glazing panel 22 is held in place by gasketing 116 and 117 near the top of the glazing panel 22 and gasketing 118 and 119 near the bottom of glazing panel 22. The gasketing 116–119 is a narrow width gasketing which minimizes the likelihood of the tape 104 and 108 from being scrapped off as the glazing panel 22 expands and contracts.

Figure 7:
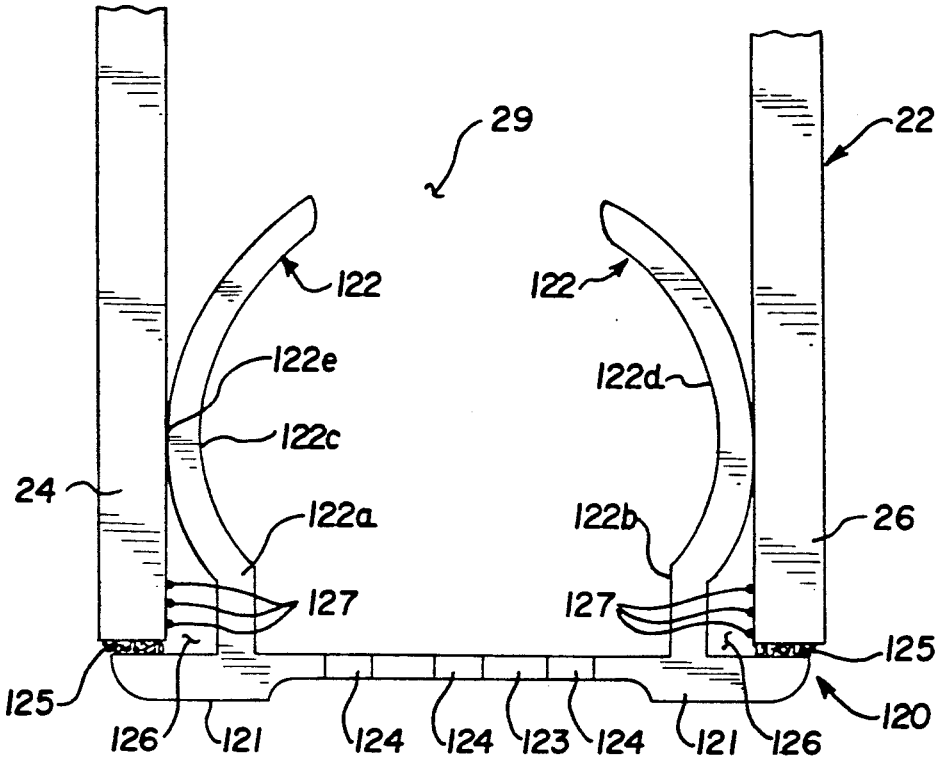
FIG. 7 shows the plastic extrusion of the invention as positioned between two glazing panels.
Figure 8:
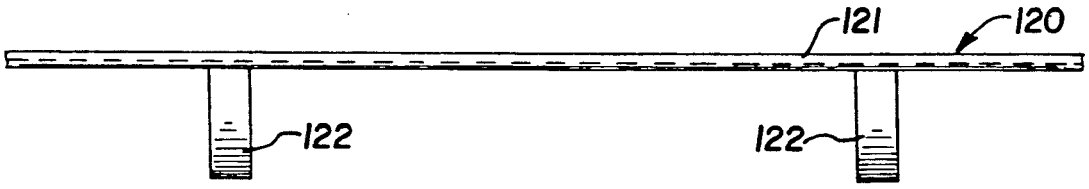
FIG. 8 is a side elevational view of the plastic extrusion of FIG. 7.
Figure 9:
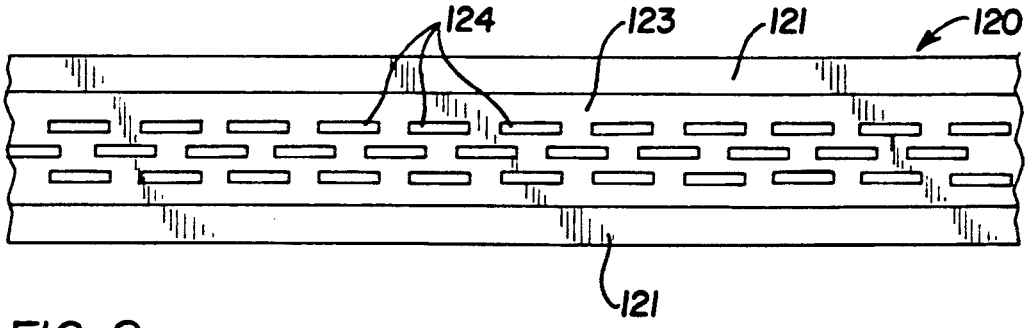
FIG. 9 is a top plan view of the plastic extrusion of FIG. 7.

FIGS. 7–9 show an alternative method of sealing the double panes of glazing panel 22. A continuously extruded plastic extrusion 120 is shown that fits in the space between the outside face 26 and inside face 24 of the glazing panel 22. The extrusion 120 has a generally planar horizontal sections 121 and spaced vertical flanges 122. The horizontal section 121 has an ultra-thin web section 123 which has perforations 124. As can be seen in FIG. 7, the web section 123 has a lower surface **123*a* and an upper surface 123*b*. The perforations 124 have an opening 124*a* in the lower surface 123*a* and a discharge end 124*b* in the upper surface 123*b*. This allows (i) air to reach and (ii) condensation to escape the space 29 between the glazing panels 24 and 26 when the extrusion 120 is secured therebetween. An alternative to this method would be to provide larger perforations and to cover those with an air permeable tape, similar to material 110 shown in FIG. 6. This allows air to reach the space 29 between the glazing faces 24 and 26 as well as provide an opening for the escape of water vapor condensation from the space 29 between the glazing faces 24 and 26. The extrusion 120 is adhered to the top of the glazing panels by an adhesive means 125 or by solvent welding. The horizontal section 121 does not extend to the outside edge of the glazing faces 24 and 26. This will resist scraping of the extrusion 120 by the gasketing 116–119 or portions of legs 40, 42 or 80, 82 during thermal contraction and expansion of the glazing panel 22**.

The flange 122 as seen in FIG. 7 has a first extending leg **122*a* and a second downwardly extending leg 122*b*. The members are connected to the horizontal section 121 inwardly of the glazing faces so that a space 126 is formed between the top portion of the members 122*a* and 122*b* and the glazing faces 24 and 26. This space 126 will accommodate burrs 127 that are formed on the edges of the glazing faces that occur during cutting of the glazing faces. In this way the burrs 127 will not interfere with the members 122*a* and 122*b***.

The members have a resilient arcuate section **122*c* and 122*d* having a portion 122*e* and 122*f* that frictionally contacts the glazing faces 24 and 26. This will hold the extrusion 120 in place in between the glazing faces 24 and 26 until the extrusion is permanently fixed to the glazing faces 24 and 26 by the adhesive means 125**.

Referring now back to FIG. 4, the sash assembly is generally moved into its opened and closed position through an operator 130. This operator 130 may be a variety of types including the rack 132 and pinion 134 illustrated in FIG. 4 or the operator could be a lever arm or a chain type. The power source for the operator 130 may be a simple hand lever, chain powered, a hand crank or electrical power in which a motor and gear drive are utilized. The operator 130 preferably connects mullions 19 to operator arm 136 via pivot pin 138.

Figure 10:
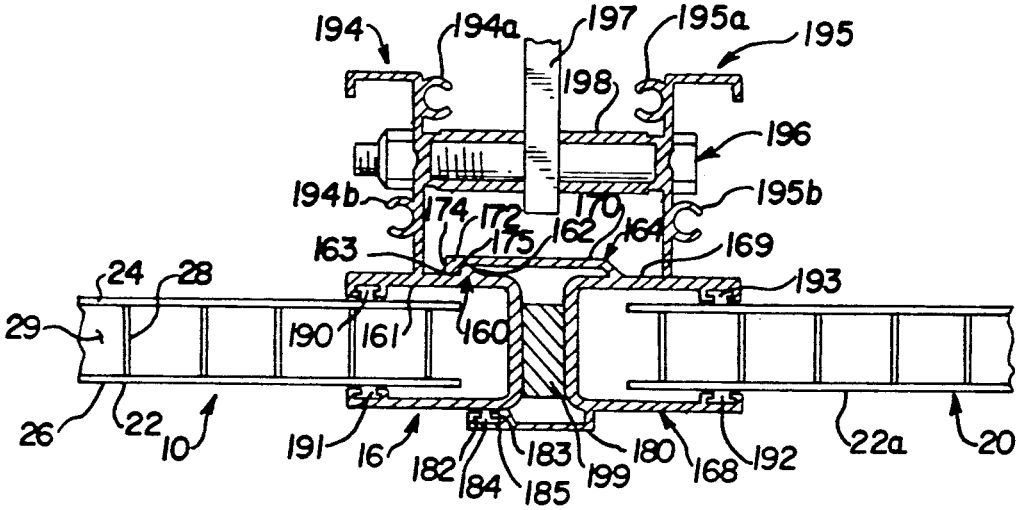
FIG. 10 is a section taken through line 10—10 of FIG. 1.

As was mentioned above, two or more sash assemblies can be connected to form a long row. FIG. 10 illustrates the joining of the sash assembly 10 and sash assembly 20. Side member 16 of sash assembly 10 has a ramp section 160 which projects from the back flange 161 thereof. The ramp section 160 has a bevelled leading edge 162 and a vertical trailing edge 163 adapted to mate with hook flange 164 that is attached to the side member 168 of second sash assembly 20. Hook flange 164 is attached to and extends from back flange 169 of side member 168 and consists of a neck 170 terminating in an enlarged projection 172. Projection 172 includes a bevelled leading edge 174 and a vertical trailing edge 175. In operation, in order to connect sash assembly 10 to sash assembly 20, relative movement of hook flange 164 and ramp section 160 is effected so that bevelled leading edge 174 rides up bevelled leading edge 162 of ramp section 160 until vertical trailing edge 175 snaps into surface-to-surface engagement with the vertical trailing edge 163 of ramp section 160. This provides positive interengagement between sash assemblies 10 and 20.

Side member 168 is also provided with a front flange 180 that has a free end 181 with nubs 182 and 183 which form a space 184 to hold weatherstripping 185. The weatherstripping 185 presses against side member 16 so as to provide a continuous seal. This seal will remain in tact regardless of the position of side member 16 with respect to side member 168 while these members are lockedly engaged. Nubs 182 and 183 bear against side member 16 so that weatherstripping 185 does not become fully crushed or worn down due to friction.

The side member 16 has gasketing 190 and 191 on the front and back of glazing panel 22. Side member 168 also has gasketing 192 and 193 on the front and back of cellular panel **22*a*. This gasketing is coated with a non-stick coating which allows the cellular panels 22 and 22*a* to freely expand and contract. A flange 194 extends rearwardly from side member 16 and a flange 195 extends rearwardly from side member 168. Flange 194 includes screw bosses 194*a* and 194*b* and flange 195 includes screw bosses 195*a* and 195*b*. A bolt and nut assembly 196, similar to bolt and nut assembly 39*k* FIG. 3, is also provided. A rack arm 197 operates the opening and closing of the window sash as was described in FIG. 4. A plastic spacer 198 is provided which keeps the rack arm 197 centered. The spacer 198** is designed to allow for thermal movement of the joint.

Installation of a plurality of sash assemblies requires accurate spacing in order to assure that the long row of sash assemblies completely fills the opening in the building. In order to assure initial assembly with a neutral spacing, a resilient spacer 199 is provided. The resilient spacer can be made from materials selected from the group consisting of foam, neoprene, urethane and any other elastomeric material. The resilient spacer 199 is attached to either side member 16 or side member 168 such as by adhesives. In installing the window constructions, spacer 199 is placed on side member 16, for example. Assembly 20 is then moved into position such that side member 168 contacts spacer 199. This is what is known as the "neutral position". Once all of the assemblies have been installed, the resilient spacer 199 is adapted to be crushed to permit full movement of the connected sash assemblies due to thermal expansion.

Figure 11:
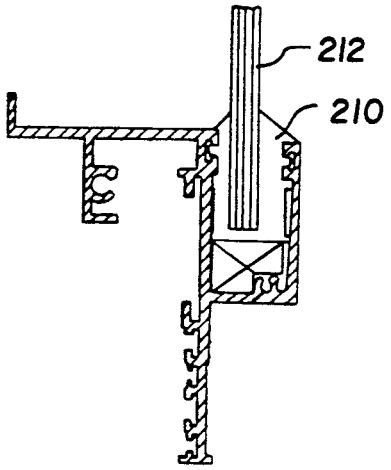
FIG. 11 is a section of an extrusion holding a glass or monolithic plastic glazing.
Figure 12:
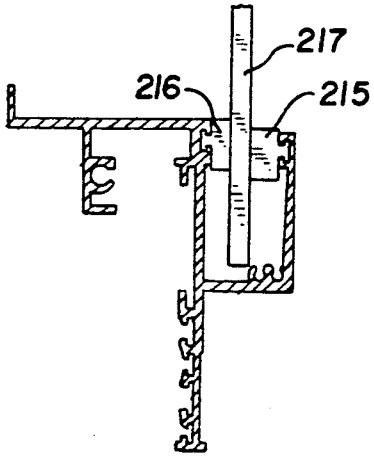
FIG. 12 is a section of an extrusion holding another glass or monolithic plastic glazing.
Figure 13:
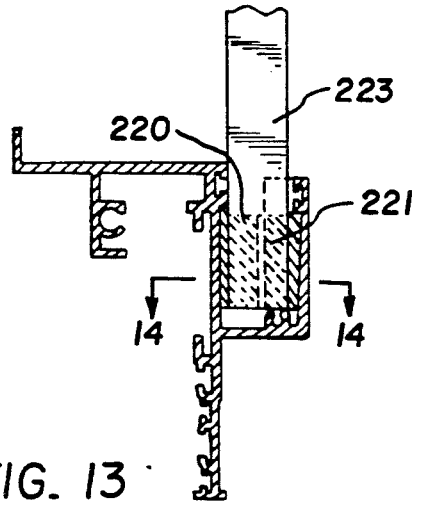
FIG. 13 is a section of a sill extrusion holding a corrugated sheet glazing.
Figure 14:
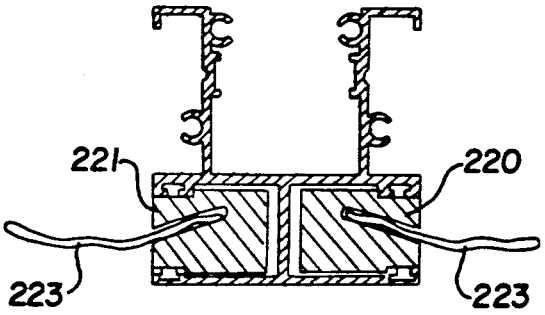
FIG. 14 is a section taken through line 14—14 of FIG. 13.

Referring to FIGS. 11–14, optional glazing for use in the sash assembly of the invention is illustrated. FIG. 11 shows a perimeter marine-type elastomeric gasketing 210 to hold a glazing 212. FIG. 12 shows elastomeric gaskets 215 and 216 of greater thickness than normal in order to accommodate a glazing 217 having a thickness less than the originally designed glazing thickness. FIGS. 13 and 14 show continuous foam closure strips 220 and 221 in a corrugated shape to accept corrugated sheet glazing 223.

It will be appreciated that a top hinged sash construction is disclosed that will provide outstanding weatherproofing qualities over those of the prior art. In addition, a window construction of at least two window sashes is provided with a ramp and hook joining means that makes joining the window sashes efficient and easy. Finally, a window construction of at least two window sashes is provided whereby a resilient spacer makes for accurate positioning of the sashes during installation and which also provides for thermal expansion of the window sashes after installation while remaining well sealed.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A top hinged sash construction adapted to be secured to a building comprising:

a hinge bar;

a frame assembly hingedly connected to said hinge bar, said frame assembly including a head extrusion member, a sill member, two side members and at least one glazing member mounted therein;

said head extrusion member having a head extrusion flange defining a head extrusion recess therein;

head extrusion weatherstripping means secured within said head extrusion recess;

said head extrusion weatherstripping means contacting said hinge bar when said frame assembly is closed against said hinge bar;

said head extrusion weatherstripping means being such that it is only partially compressed when said frame assembly is closed against said hinge bar; and said head extrusion recess being defined by a plurality of protrusions projecting from said head extrusion flange, said protrusions limiting the compression of said head extrusion weatherstripping means when said frame assembly is closed against said hinge bar.

2. The construction of claim 1, wherein said head extrusion weatherstripping means includes a foam core surrounded by an exterior covering made of elastomeric material.

3. The construction of claim 2, wherein said head extrusion weatherstripping means has a base portion and an enlarged bulb portion, said base portion being secured within said head extrusion recess.

4. The construction of claim 1 including at least one vertical mullion extending between said head extrusion and said sill member.

5. The construction of claim 4, wherein said vertical mullion connected to said head extrusion and said sill member by fastener means.

6. The construction of claim 5, wherein at least one of said fastener means including a screw having a head and a neck, said neck having an unthreaded portion and a threaded portion, said unthreaded portion disposed between said head and said threaded portion, whereby said screw may be tightened while resisting threading into both said vertical mullion and either said head extrusion member or said sill member.

7. The construction of claim 1, wherein said sill member includes setting fin means upon which said glazing member can rest.

8. The construction of claim 1, wherein said glazing member has a first face and a second face in spaced relationship.

9. The construction of claim 8, including means for enclosing the space between said first and second faces of said glazing member.

10. The construction of claim 9, wherein said enclosing means is a foil tape attached to the ends of said faces of said glazing members, said foil tape having moisture permeable vents formed therein.

11. The construction of claim 9, wherein said enclosing means is a plastic extrusion.

12. The construction of claim 11, wherein said plastic extrusion includes a horizontal section and a pair of spaced vertical legs attached to said horizontal section.

13. The construction of claim 12, wherein said horizontal section has a plurality of perforations for permitting venting of moisture from within said space between said first and second faces.

14. The construction of claim 13, including moisture permeable tape covering said perforations.

15. The construction of claim 1, wherein said glazing member is a glass panel and an elastomeric glazing, said elastomeric glazing holding said glass panel in said head extrusion and sill member.

16. The construction of claim 1 wherein said glazing member is a corrugated plastic panel.

17. A top hinged sash construction adapted to be secured to a building comprising:

a hinge bar;

a frame assembly hingedly connected to said hinge bar, said frame assembly including a head extrusion member, a sill member, two side members and at least one glazing member mounted therein;

said head extrusion member having a head extrusion flange defining a head extrusion recess therein;

head extrusion weatherstripping means secured within said head extrusion recess;

said head extrusion weatherstripping means contacting said hinge bar when said frame assembly is closed against said hinge bar;

said head extrusion weatherstripping means being such that it is only partially compressed when said frame assembly is closed against said hinge bar;

said sill member including a sill member flange defining a sill member recess;

sill member weatherstripping means secured within said sill member recess;

said sill member weatherstripping means contacting said building when said frame assembly is closed against said building;

said sill member weatherstripping means being such that it is only partially compressed when said frame assembly is closed against said hinge bar; and said sill member recess being defined by a plurality of protrusions projecting from said sill member flange means, said protrusions limiting the compression of said sill member weatherstripping means when said frame assembly is closed against said building.

18. A top hinged sash construction adapted to be secured to a building comprising:

a hinge bar;

a frame assembly hingedly connected to said hinge bar, said frame assembly including a head extrusion member, a sill member, two side members and at least one glazing member mounted therein;

said head extrusion member having a head extrusion flange defining a head extrusion recess therein;

head extrusion weatherstripping means secured within said head extrusion recess;

said head extrusion weatherstripping means contacting said hinge bar when said frame assembly is closed against said hinge bar;

said head extrusion weatherstripping means being such that it is only partially compressed when said frame assembly is closed against said hinge bar; and said hinge bar including a hinge rail extending from said hinge bar;

said hinge rail having secured thereto a hinge rail flange which defines a hinge rail recess;

said head extrusion member having a hinge rail engaging flange which is hingedly disposed in said hinge rail recess; and said hinge rail engaging flange having a projection which contacts said hinge rail flange when said frame assembly is closed against said hinge bar, whereby head extrusion weatherstripping means is further sealed against said hinge bar when said frame assembly is closed against said hinge bar.

19. A top hinged sash construction adapted to be secured to a building comprising:

a hinge bar;

a frame assembly hingedly connected to said hinge bar, said frame assembly including a head extrusion member, a sill member, two side members and at least one glazing member mounted therein;

said head extrusion member having a head extrusion flange defining a head extrusion recess therein;

head extrusion weatherstripping means secured within said head extrusion recess;

said head extrusion weatherstripping means contacting said hinge bar when said frame assembly is closed against said hinge bar;

said head extrusion weatherstripping means being such that it is only partially compressed when said frame assembly is closed against said hinge bar;

said glazing member having a first face and a second face in spaced relationship;

means for enclosing the space between said first and second faces of said glazing member;

said plastic extrusion includes a horizontal section and a pair of spaced vertical legs attached to said horizontal section;

said horizontal section has a plurality of perforations for permitting venting of moisture from within said space between said first and second faces;

moisture permeable tape covering said perforations; and the edges of said horizontal section are spaced inwardly from the outside edge of said first face and said second face.

20. The construction of claim 19, wherein a portion of each of said vertical flanges is spaced from the sides of said respective glazing members such that vertical flange contact with burrs on said glazing members is resisted.

21. A window construction comprising:

a first top hung hinged window sash having (i) a hinge bar; and (ii) a frame assembly hingedly connected to said hinge bar, said frame assembly having a head extrusion member, a sill member, two side members and at least one glazing member mounted in said frame assembly;

a second top hung hinged window sash having (i) a hinge bar; and (ii) a frame assembly hingedly connected to said hinge bar, said frame assembly having a head extrusion member, a sill member, two side members and at least one glazing member mounted in said frame assembly;

means to join said first top hung hinged window sash to said second top hung hinged window sash; and said joining means including a hook member attached to one of said window sashes and a ramp member attached to the other said window sash, whereby said window sashes are joined by effecting relative movement of said hook member and said ramp member to effect interengagement therebetween.

22. The construction of claim 21, wherein said hook member includes a flange having one end connected to one of said window sashes and a free end with a bevelled leading edge and a straight trailing edge; and said ramp member has a bevelled edge and a straight edge, whereby said hook member bevelled leading edge can ride over said ramp member bevelled edge and said hook member straight trailing edge can be in intimate surface-to-surface contact with said ramp member straight edge when said window sashes are interengaged.

23. A window construction comprising:

a first top hung hinged window sash having (i) a hinge bar; and (ii) a frame assembly hingedly connected to said hinge bar, said frame assembly having a head extrusion member, a sill member, two side members and at least one glazing member mounted in said frame assembly;

a second top hung hinged window sash having (i) a hinge bar; and (ii) a frame assembly hingedly connected to said hinge bar, said frame assembly having a head extrusion member, a sill member, two side members and at least one glazing member mounted in said frame assembly;

means to position said window sashes in a building opening; and said positioning means has means for maintaining the proper distance between said window sashes during installation but which also permits subsequent thermal expansion of said window sashes relative to each other.

24. The window construction of claim 23, wherein said positioning means is a resilient spacer disposed in between said first and second window sashes.

25. The window construction of claim 24, wherein said resilient spacer is made of a material selected from the group consisting of foam, neoprene, urethane and other elastomeric materials.

26. The window construction of claim 25, wherein said resilient spacer is attached to said first window sash or said second window sash.

27. A top hinged sash construction adapted to be secured to a building comprising:

a hinge bar;

a frame assembly hingedly connected to said hinge bar, said frame assembly including a head extrusion member, a sill member, two side members and at least one glazing member mounted therein;

said head extrusion member having a head extrusion flange defining a head extrusion recess therein;

head extrusion weatherstripping means secured within said head extrusion recess;

said head extrusion weatherstripping means contacting said hinge bar when said frame assembly is closed against said hinge bar;

said head extrusion weatherstripping means being such that it is only partially compressed when said frame assembly is closed against said hinge bar;

at least one vertical mullion extending between said head extrusion and said sill member;

said vertical mullion connected to said head extrusion and said sill member by fastener means; and at least one of said fastener means including a screw having a head and a neck, said neck having an unthreaded portion and a threaded portion, said unthreaded portion disposed between said head and said threaded portion, whereby said screw may be tightened while resisting threading into both said vertical mullion and either said head extrusion member or said sill member.

28. An elongated rigid extrusion for securement between two spaced glazing members, said extrusion comprising:

an elongated generally horizontal body portion having an upper surface and a lower surface;

said body portion having at least one opening in communication with said lower surface and another end which is a discharge end so that (i) air can reach and (ii) condensation can escape the space between said glazing members when said extrusion is secured therebetween; and said body portion width is dimensioned such that the edges of said body portion are adapted to be spaced inwardly from the outside edge of each of said glazing members when said extrusion is secured therebetween.

29. The extrusion of claim 28, including a pair of spaced vertical legs attached to said body portion.

30. The extrusion of claim 29, including moisture permeable tape covering said opening.

31. The extrusion of claim 30, wherein said body portion has a web section; and said opening is created in said web section.

32. The extrusion of claim 28, wherein said discharge end is in communication with said upper surface of said body portion.

33. A method of joining at least two top hung hinged window sashes comprising:

providing a first top hung hinged window sash having (i) a hinge bar; and (ii) a frame assembly hingedly connected to said hinge bar, said frame assembly having a head extrusion member, a sill member, two side members and at least one glazing member mounted in said frame assembly;

providing a second top hung hinged window sash having (i) a hinge bar adapted for securement to a building; (ii) a frame assembly hingedly connected to said hinge bar, said frame assembly having a head extrusion member, a sill member, two side members and at least one glazing member mounted in said frame assembly;

providing a hook member attached to one of said window sashes and a ramp member attached to the other of said window sashes; and effecting relative movement of said hook member and said ramp member to effect engagement therebetween.

34. A method of positioning at least two top hung hinged window sashes comprising:

providing a first top hung hinged window sash including (i) a hinge bar; and (ii) a frame assembly hingedly connected to said hinge bar, said frame assembly having a head extrusion member, a sill member, two side members and at least one glazing member mounted in said frame assembly;

providing a second top hung hinged window sash including (i) a hinge bar; and (ii) a frame assembly hingedly connected to said hinge bar, said frame assembly having a head extrusion member, a sill member, two side members and at least one glazing member mounted in said frame assembly;

providing a resilient spacer means between said first window sash and said second window sash; and effecting relative movement of said first and second window sash to effect contacting engagement with said resilient spacer, whereby said resilient spacer maintains the proper distance between said window sashes during installation thereof and whereby said spacer is adapted to permit subsequent thermal expansion of said window sashes relative to each other after installation thereof.

35. The method of claim 30, wherein before effecting relative movement of said first and second window sash, attaching said resilient spacer means to said first window sash.

36. The method of claim 35, wherein before effecting relative movement of said first and second window sash, attaching said resilient spacer means to said second window sash.

* * * * *